US011208737B2

(12) United States Patent
Mugge et al.

(10) Patent No.: US 11,208,737 B2
(45) Date of Patent: Dec. 28, 2021

(54) PROCESS AND DEVICE FOR SPLITTING A TAPE

(71) Applicant: TEIJIN ARAMID B.V., Arnhem (NL)

(72) Inventors: Edo Mugge, Wijchen (NL); René Journée, Loo (NL)

(73) Assignee: TEIJIN ARAMID B.V., Arnhem (NL)

( * ) Notice: Subject to any disclaimer, the term of this patent is extended or adjusted under 35 U.S.C. 154(b) by 134 days.

(21) Appl. No.: 16/080,109

(22) PCT Filed: Jan. 26, 2017

(86) PCT No.: PCT/EP2017/051653
§ 371 (c)(1),
(2) Date: Aug. 27, 2018

(87) PCT Pub. No.: WO2017/148628
PCT Pub. Date: Sep. 8, 2017

(65) Prior Publication Data

US 2019/0062949 A1 Feb. 28, 2019

(30) Foreign Application Priority Data

Mar. 3, 2016 (EP) ..... 16158464

(51) Int. Cl.
*D01D 5/42* (2006.01)
*D04H 13/02* (2006.01)
*D07B 1/02* (2006.01)

(52) U.S. Cl.
CPC ..... *D01D 5/423* (2013.01); *D01D 5/426* (2013.01); *D04H 13/02* (2013.01); *D07B 1/025* (2013.01); *D07B 2201/1096* (2013.01); *D07B 2201/2003* (2013.01); *D07B 2205/2014* (2013.01)

(58) Field of Classification Search
CPC ..... D01D 5/423; D01D 5/426; D07B 1/025
See application file for complete search history.

(56) References Cited

U.S. PATENT DOCUMENTS 3,302,501 A * 2/1967 Greene ..... D01D 5/423 83/867
3,416,772 A * 12/1968 Sheehan ..... D01D 5/423 225/3

(Continued)

FOREIGN PATENT DOCUMENTS

WO 2009/007045 A1 1/2009
WO 2010/079172 A1 7/2010
WO 2013/092622 A1 6/2013

OTHER PUBLICATIONS

Apr. 11, 2017 International Search Report issued in International Patent Application No. PCT/EP2017/051653.

(Continued)

*Primary Examiner* — Shaun R Hurley
(74) *Attorney, Agent, or Firm* — Oliff PLC

(57) ABSTRACT

A process and a splitter for splitting a tape of a uniaxially oriented material. The tape is passed in a process direction over a splitting profile having a row of parallel teeth with a cutting edge extending in the process direction. The tape is split to form a tape comprising a plurality of parallel strips interconnected by fibrils. The split tape can for example be used for the production of high tensile ropes.

6 Claims, 3 Drawing Sheets

(56) References Cited

Figure 1:
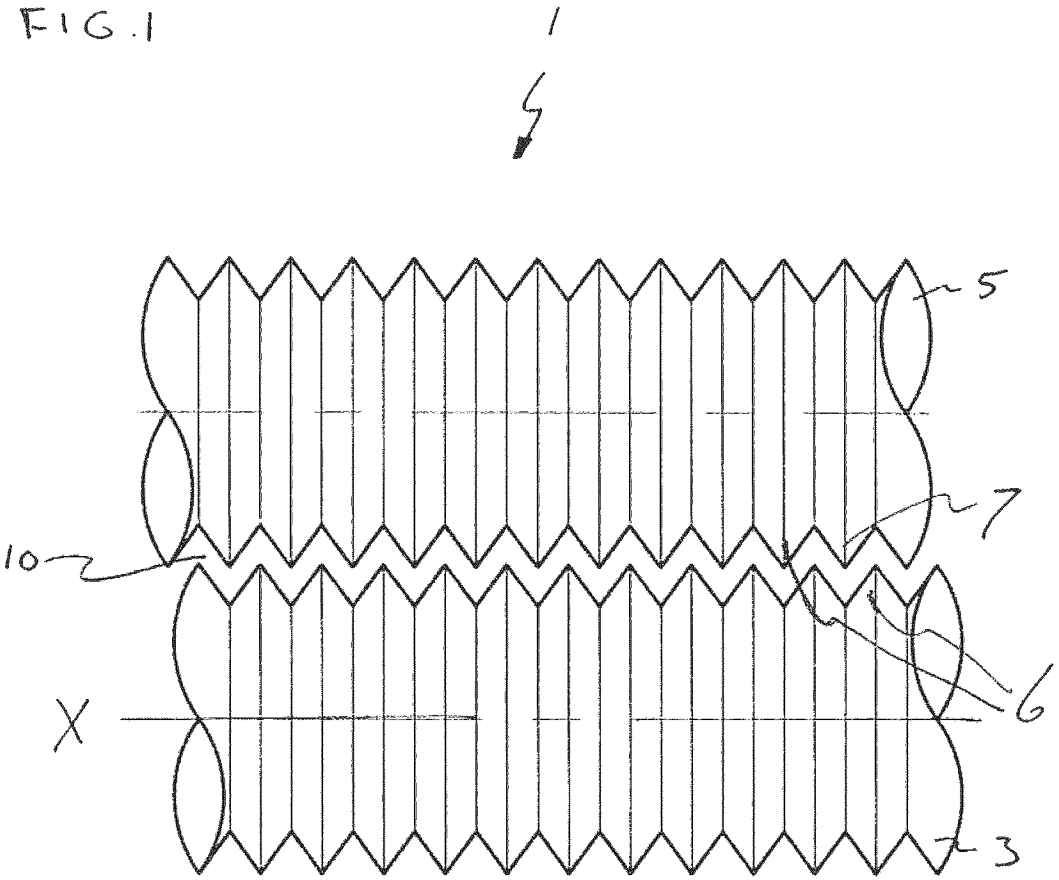

U.S. PATENT DOCUMENTS 3,492,389 A * 1/1970 Port ..... D01D 5/423 264/147
3,500,517 A 3/1970 Dekker et al.
3,567,545 A * 3/1971 Bobkowicz et al. .. D02G 3/402 156/229
3,577,724 A * 5/1971 Greene ..... D01D 5/423 57/31
3,596,816 A * 8/1971 Brown ..... D01D 5/423 225/2
3,606,115 A * 9/1971 Matsui ..... D01D 5/423 225/97
3,621,646 A * 11/1971 Bobkowicz et al. .... D01D 5/00 57/224
3,624,996 A * 12/1971 Shepherd et al. ..... B66B 1/24 57/408
3,639,573 A * 2/1972 Port ..... D01D 5/426 264/75
3,662,935 A * 5/1972 Yazawa ..... B26F 1/20 225/97
3,702,055 A * 11/1972 Kosaka ..... D01D 5/423 57/31
3,726,079 A * 4/1973 Feild ..... D01D 5/423 428/85
3,739,053 A * 6/1973 Yazawa ..... D01D 5/423 264/154
3,756,484 A 9/1973 Guenther
3,761,552 A * 9/1973 Chill ..... B29C 48/19 264/37.28
3,791,129 A 2/1974 Shuford
3,835,513 A * 9/1974 Stanley ..... D02G 1/12 28/221
3,883,936 A * 5/1975 Stanley ..... D02G 1/12 28/221
3,927,957 A * 12/1975 Chill ..... B29C 55/065 425/131.1
3,985,600 A * 10/1976 Blais ..... B26F 1/20 156/229
4,039,734 A * 8/1977 Hendy ..... B01J 19/0006 526/258
4,065,538 A * 12/1977 Gustafson ..... D01D 5/42 264/154
4,134,951 A * 1/1979 Dow ..... D01D 5/42 264/147
4,697,407 A * 10/1987 Wasserman ..... D01D 5/42 428/372
5,104,367 A * 4/1992 Hill ..... D01D 5/423 264/154
5,168,685 A * 12/1992 Suzuki ..... B65B 11/045 53/141
5,240,160 A * 8/1993 Okada ..... B26F 1/20 225/97
5,578,373 A 11/1996 Kobayashi et al.
5,861,202 A * 1/1999 Kimura ..... B32B 27/32 428/105
8,616,110 B2 * 12/2013 Silva ..... B26D 1/22 83/102
10,577,727 B2 * 3/2020 Xia ..... D02G 3/367
2015/0152593 A1 6/2015 Darda et al.
2017/0153090 A1 * 6/2017 Van Putten ..... F41H 5/0485
2018/0216254 A1 * 8/2018 Xu ..... D01D 5/16

OTHER PUBLICATIONS

Apr. 11, 2017 Written Opinion issued in International Patent Application No. PCT/EP2017/051653.
Sep. 4, 2018 International Preliminary Report on Patentability issued in International Patent Application No. PCT/EP2017/051653.
Talebi et al; "Molar Mass and Molecular Weight Distribution of UHMWPE Synthesized Using a Living Homogeneous Catalyst;" Macromolecules Article; vol. 43; No. 6; Feb. 23, 2010.

* cited by examiner

PROCESS AND DEVICE FOR SPLITTING A TAPE

The invention pertains to a process and a device for splitting a tape, in particular of a uniaxially oriented thermoplastic material, e.g., for producing a rope, in particular high-tensile ropes comprising one or more strands made of uniaxially oriented tape material. Such ropes are used for high tensile loads, such as with mooring, towing, lifting, offshore installation, fishing lines or nets, or cargo nets. Such tapes can also be used to form one or more layers in a laminate.

WO 2013/092622 discloses a rope made of by simultaneously twisting and fibrillating strands of uniaxially oriented tapes of ultra-high molecular weight polyethylene (UHMWPE). The drawback of such a rope making process is that the resulting rope is not uniform over its length. Other ropes are produced using tapes with a small width, e.g., of 2 mm or less, such as the Endumax® 2 mm tapes of Teijin. Such tapes may for example be made by cutting a tape of a larger width to a number of tapes having the desired smaller width. Cutting narrow tapes from a wider one has the drawback that fibrils are cut so the overall joint tensile strength of the narrower tapes would be less than the tensile strength of the original wider tape. The wide tapes are supplied as a roll and cut into narrow tapes, which are subsequently wound separately. In a next step, the wound narrow tapes are unwound and twisted to form a cord or rope.

It is an object of the invention to provide a tape material overcoming the above mentioned problems.

The object of the invention is achieved with a process wherein a tape of a uniaxially oriented material is passed in a process direction over a splitting profile having a row of parallel teeth which are triangular when viewed in process direction. This way, the tape is split into a desired number of strips which are still interconnected by fibrils. These fibrils are not cut or damaged. Due to the fibrils, the individual strips do not have to be rewound before they can be used to twist a rope. The rope can directly be made from the split tape. This simplifies the overall process. It has also been found that this substantially increases the tensile strength of the final product.

Particularly good results are achieved if the splitting profile is static, e.g., an ax with triangular teeth, e.g., showing a zigzag pattern when viewed in process direction.

In a specific embodiment, each of the teeth may comprise a cutting edge defining a circle or circular segment, the teeth being coaxially arranged. The radius of the cutting edges may for example be at most 25 mm, e.g., at most 20 mm. Larger radii can also be used. The distance between the cutting teeth may for example be about 0.5-8 mm, e.g., about 1.5-2.5 mm, e.g., about 1.8-2.2 mm. The height of the cutting edges may for example be in the range of 0.5-12 mm, e.g. about 1-5 mm, e.g., about 2-3 mm.

The tape to be split may for example pass the splitting profile with a processing speed of at least about 1 m/min or less, e.g., at least about 2 m/min, e.g., to a maximum of about 200 m/min, or even higher.

Good results are obtained if the tape is fed to the splitting profile with an entrance angle of 0-90 degrees to the horizontal.

The tape may for example exit the splitting profile with an exit angle of 0-90 degrees to the horizontal.

During the splitting process the web tension may for example be about 0-3 N/mm.

The invention also relates to a tape of a uniaxially oriented material comprising as plurality of parallel strips interconnected by fibrils. Each of the strips is connected at one or at both of its longitudinal sides to an adjacent parallel strip. With uniaxially oriented material is meant that the tapes exhibit an orientation of the polymer chains in one direction. Such material shows anisotropic mechanical properties.

The uniaxially oriented material may for example be or comprise polyethylene, e.g., UHMWPE. The UHMWPE may be linear or branched. Linear polyethylene has less than 1 side chain per 100 carbon atoms, e.g., less than 1 side chain per 300 carbon atoms, a side chain or branch generally containing at least 10 carbon atoms. Side chains can be measured by FTIR on a 2 mm thick compression moulded film. Linear polyethylene may further contain up to 5 mol % of one or more other copolymerisable alkenes, such as propene, butene, pentene, 4-methylpentene, and/or octene. The linear polyethylene can be of high molar mass with an intrinsic viscosity (IV, as determined on solutions in decalin at 135° C.) of at least 4 dl/g; e.g., of at least 8 dl/g, e.g., of at least 10 dl/g. The ultra-high molecular weight polyethylene may for example have a weight average molecular weight (Mw) of at least 500 000 gram/mol in particular between $1*10^6$ gram/mole and $1*10^8$ gram/mol. In one embodiment, the polyethylene has a number average molecular weight (Mn) of at least $2.0*10^5$ g/mol. The Mn may be at least $5.0*10^5$ g/mol, more in particular at least $8.0*10^5$ g/mol, or even at least 1.0 million g/mol, or even at least 1.2 million gram/mol. The use of a polymer with a relatively high Mw has the advantage of a relatively high strength; the use of the polymer with a relatively high Mn has the advantage that it contains a relatively low amount of low-molecular weight polyethylene, and as it is believed that the properties of the tape derived from the high molecular weight molecules the presence of fewer low-molecular weight molecules will lead to a tape with better properties. The use of a polymer with a relatively high Mw in combination with a relatively high Mn may be particularly preferred. The Mn and Mw may be determined as is described in WO2010/079172. Reference may also be made to S. Talebi et al. in Macromolecules 2010, Vol. 43, pages 2780-2788. In one embodiment, the tapes are based on disentangled PE, e.g., as described in WO 2009/007045, and WO2010/079172.

To form a rope the tapes can be combined with further tapes, strips, yarns and/or filaments, which may for instance comprise polyolefins, polyesters, polyvinyl alcohols, polyacrylonitriles, polyamides, liquid crystalline polymers and ladder-like polymers, such as polybenzimidazole or polybenzoxazole.

Tapes of uniaxially oriented UHMWPE may be prepared by drawing films. Films may be prepared by compacting a UHMWPE powder at a temperature below its melting point and by rolling and stretching the resulting polymer. An example of such a process is disclosed in U.S. Pat. No. 5,578,373.

Alternatively, UHMWPE powder can be fed to an extruder, extruding a film at a temperature above the melting point. Before feeding the polymer to the extruder, the polymer may be mixed with a suitable liquid organic compound, for instance to form a gel.

The UHMWPE films can then be drawn or stretched in one or more consecutive steps to obtain the desired uniaxially oriented tapes.

The width of the tapes can for example be more than 3 mm, e.g., more than 8 mm, e.g., more than 15 mm, e.g., more than 100 mm. The thickness of the tapes may for example be at least about 30 μm, e.g., up to about 200 μm The areal density of the tapes can for example be between 2 and 200 g/m$^2$, e.g., between 10 and 170 g/m$^2$, e.g., between 10 and 100 g/m$^2$, e.g., between 20 and 60 g/m$^2$.

Linear density is measured by determining the weight in mg of 10 meters of material and is conveniently expressed in dtex (g/10 km) or denier (den, g/9 km). The linear density of the tape may depend upon the areal density of the tape, the width of the tape and the twist level of the tape. The linear density of the tape may for example be in the range from 400 dtex (360 den) to 200.000 dtex (180000 den), e.g., in the range from 1000 dtex (900 den) to 100000 dtex (90000 den), e.g., in the range from 2000 dtex (1800 den) to 50000 dtex (45000 den).

The tensile strength of the tapes prior to splitting depends on the used type of UHMWPE and on their stretch ratio. The tensile strength of the tapes may for example be at least 0.9 GPa, e.g., at least 1.5 GPa, e.g., at least 2.1 GPa, e.g., at least 3 GPa.

In one embodiment, the tapes may have a 200/110 uniplanar orientation parameter Φ of at least 3. The 200/110 uniplanar orientation parameter Φ is defined as the ratio between the 200 and the 110 peak areas in the X-ray diffraction (XRD) pattern of the tape sample as determined in reflection geometry. The 200/110 uniplanar orientation parameter gives information about the extent of orientation of the 200 and 110 crystal planes with respect to the tape surface. For a tape sample with a high 200/110 uniplanar orientation the 200 crystal planes are highly oriented parallel to the tape surface. It has been found that a high uniplanar orientation is generally accompanied by a high tensile strength and high tensile energy to break. It may be preferred for the 200/110 uniplanar orientation parameter Φ to be at least 4, more in particular at least 5, or at least 7. Higher values, such as values of at least 10 or even at least 15 may be particularly preferred. The theoretical maximum value for this parameter is infinite if the peak area 110 equals zero. High values for the 200/110 uniplanar orientation parameter are often accompanied by high values for the strength and the energy to break. The 200/110 uniplanar orientation parameter Φ may be determined as is described in WO2010/007062, page 9, line 19, through page 11, line 17.

The tape is split into a plurality of strips interconnected by fibrils. The number of fibrils per cm strips may for example be up to about 100, e.g., up to about 60, e.g., up to about 40. The fibrils can have a width of, e.g., about 100 nm up to about 1 mm or more.

After the tape is split into the plurality of strips interconnected by fibrils, a rope may be assembled by twisting one or more strands comprising the interconnected strips. Such strands may also comprise more than one sub-strands or secondary strands. Each strand or secondary strand may comprise at least one split tape.

The twisted strand and/or the rope comprising the twisted strand may subsequently be stretched. Such a post-stretching step may for example be performed at elevated temperature but below the melting point of the lowest melting tape in the strands (heat-stretching). For a rope containing tape comprising UHMWPE, the temperature may for example be in the range 100-150° C.

The rope may for instance have a substantially circular cross section or an oblong cross-section, such as a flattened, oval, or rectangular cross section. Such oblong cross-sections may for example have width to height ratio in the range from 1:1.2 to 1:4.

The rope may for example be laid, braided, plaited, parallel, with or without a core, having any suitable number of strands. A parallel rope may be constructed with at least a single strand. The number of strands in more complex ropes may e.g., be at least 3, e.g., at most 50, e.g., at most 25, to arrive at a combination of good performance and ease of manufacture.

Braiding provides a robust and torque-balanced rope that retains its coherency during use. Suitable braiding constructions include soutache braids, tubular or circular braids, and flat braids. Tubular or circular braids generally comprise two sets of strands that are intertwined, with different patterns possible. The number of strands in a tubular braid may vary widely. Especially if the number of strands is high, and/or if the strands are relatively thin, the tubular braid may have a hollow core; and the braid may collapse into an oblong shape. The number of strands in a braided rope may for example be in the range of 4-48.

Alternatively, the rope can be of a laid construction having a lay length, wherein the lay length, i.e. the length of one turn of a strand in a laid construction, or of a braided construction having a braiding period, i.e. the pitch length of the braided rope, which is in the range of from 4 to 20 times the diameter of the rope. A higher lay length or braiding period may result in a rope having higher strength efficiency. The lay length or braiding period may for instance be about 5-15 times the diameter of the rope, e.g., about 6-10 times the diameter of the rope.

Optionally, the rope and/or the tapes in the rope may be coated with a coating, e.g., for improving abrasion resistance or bending fatigue or other mechanical or physical properties. Such coatings can be applied to the tape before construction of the rope, or onto the rope after it is constructed. Examples include coatings comprising silicone oil, bitumen, polyurethane or mixtures thereof. The coating of the rope may for example be about 2.5-35 wt % by total weight of the rope.

The tapes can also be used to form a layer in a laminate, e.g. a cross-ply laminate. The laminate may for example comprise a foil layer and layer formed by at least one tape of the present disclosure. The tape can be spread before lamination.

The invention also relates to a device for splitting a tape of uniaxially oriented material comprising a splitter profile, a tape feeder for feeding tape to the splitter in a process direction, the splitter profile having a row of parallel teeth which are triangular when viewed in the process direction.

Particularly good results are obtained if the splitter comprises a counterprofile, the splitter profile and the counterprofile forming a nip for passage of the tapes, the counterprofile having teeth intermeshing with the those of the splitter profile.

The invention is further explained with reference to the accompanying drawings.

Figure 2:
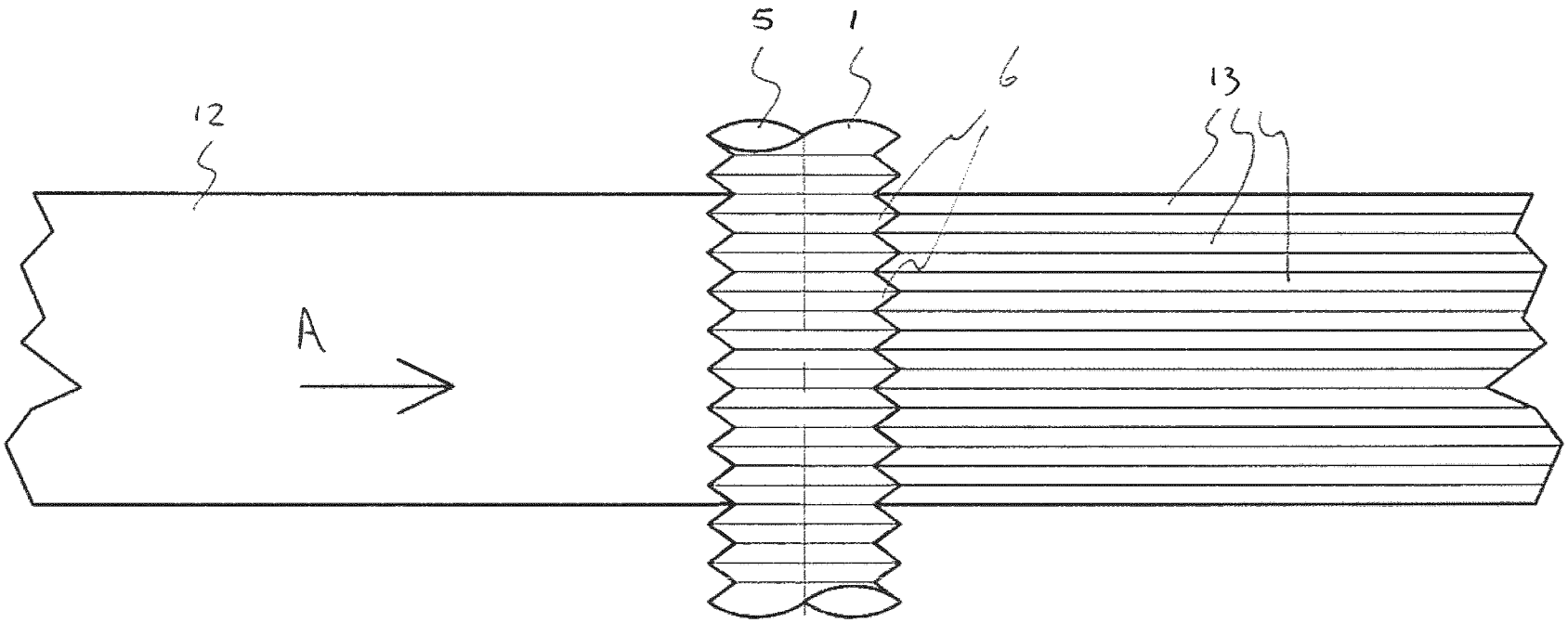
Figure 3:
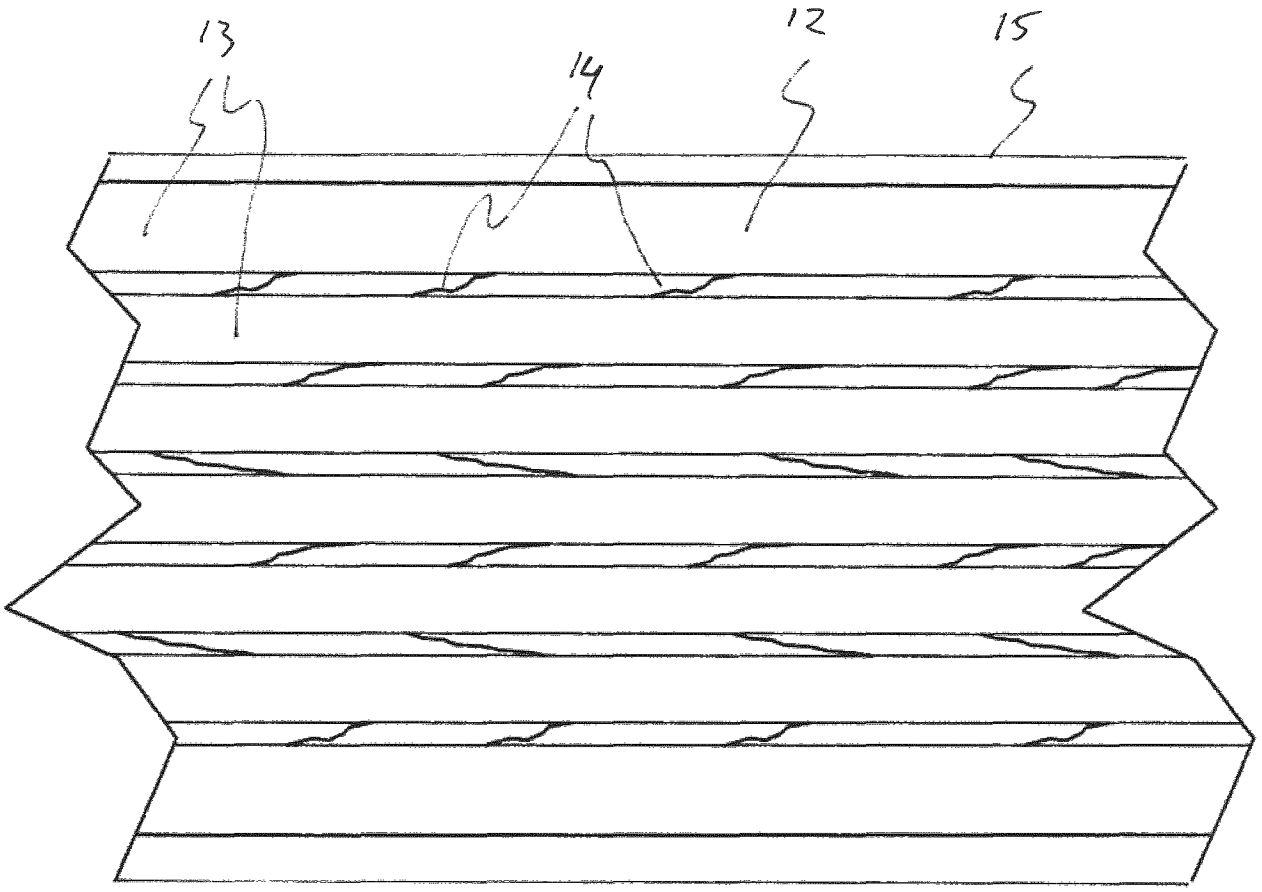
Figure 4:
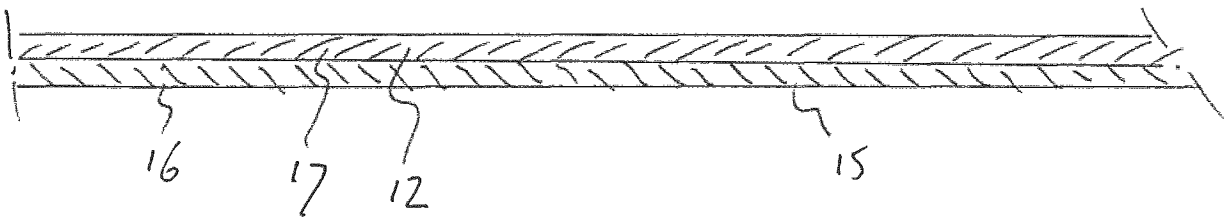

FIG. 1: shows in front view an exemplary embodiment of a splitting unit;

FIG. 2: shows the splitting unit of FIG. 1 in top view during a splitting process;

FIG. 3: shows in top view a laminate comprising processed tape material;

FIG. 4: shows the laminate in side view.

FIG. 1 shows a splitter 1 for splitting UHMWPE tapes, or tapes of a similar high tensile material, to form strips for twisting a high tensile rope. The splitter 1 comprises a profile 3 and a counterprofile 5. The profile 3 and the counterprofile 5 are parallel and have teeth 6 with cutting edges 7. The teeth 6 are triangular when viewed in a direction perpendicular to a longitudinal axis X of the profile 3. The cutting edges 7 of the counterprofile 5 intermesh with those of the profile 3 to form a zig-zag nip 10 for passage of the tapes. The tapes pass the nip 10 in a process direction A perpendicular to the plane of the drawing in FIG. 1 (see FIG. 2).

In the shown embodiment the profile 3 and the counter profile 5 are two parallel mainly cylindrical bodies. However, the profile and counterprofile may have any other suitable shapes, provided that they define a zig-zag nip between intermeshing triangular cutting edges.

FIG. 2 shows in top view how a tape 12 is guided via the splitter 1. The cutting teeth 6 of the profile 3 and the counterprofile 5 split the tape 12 into a plurality of strips 13. These strips 13 are not completely separated but are still interconnected by individual fibrils 14, as is shown in FIG. 3.

The tapes 12 can for example be used in a laminate 15, as is shown in FIGS. 3 and 4. The laminate 15 comprises a foil layer 16 and layer 17 formed by the tape 12. The tape 12 is spread to increase the distance between the individual strips 13 of the tape 12. The foil carrier may for instance be an LDPE or HDPE layer. The tape can be laminated at a temperature just above the melting temperature of the foil carrier but below the melting temperature of the tape material. The laminate can have more layers formed by one or more tapes, e.g. between the enforced layer and the foil and/or on top of the foil and/or on top of the tape-reinforced layer. Such laminates have a high impact resistance.

EXAMPLE 1

Five cords were made of tapes of a UHMWPE (Endumax® TA23, available from Teijin, the Netherlands). The tape width was 133 mm and the linear density was 62000 dtex. The tapes had been split in accordance with the invention with a pitch of 2 mm. The breaking force was measured using a test method in accordance with ASTM D7269 using a gauge length of 500 mm and a test speed of 150 mm/min. The used clamp type was Musschel 100 kN. The average breaking force was BF=10.44 kN.

The test was repeated under the same conditions using cords with identical tapes which had not been split. These cords had a breaking strength of 8.98 kN, which is more than 16% less than the strength of the cords according to the invention.

EXAMPLE 2

Cords were made of 20 mm tapes of UHMWPE (Endumax® TA23) with twist factor 30. In a first group the 20 mm tapes had been split in accordance with the invention, using a 2 mm pitch. In a second group the 20 mm tapes had been split in accordance with the invention, using a 2.5 mm pitch. In a third group the cords were made of 10 unsplit 2 mm tapes. These tapes of the third group were not according to the invention and were not interconnected by fibrils.

The breaking strength and the breaking tenacity were tested in accordance with ASTM D7269.

Table 1 shows the breaking strength and the breaking tenacity of the tested cords.

TABLE 1

| | Cords of split tapes (2 mm) | Cords of split tapes (2.5 mm) | Cords of unsplit tapes (Greige) |
|---|---|---|---|
| Linear density | 9760 dtex | 9730 dtex | 9018 dtex |
| Breaking strength | 1680 N | 1720 N | 1470 N |
| Breaking tenacity | 1720 mN/tex | 1770 mN/tex | 1630 mN/tex |

EXAMPLE 3

Cords were made of 20 mm tapes of UHMWPE (Endumax® TA23) with twist factor 45. In a first group the 20 mm tapes had been split in accordance with the invention, using a 2 mm pitch. In a second group the 20 mm tapes had been split in accordance with the invention, using a 2.5 mm pitch. In a third group the cords were made of 10 unsplit 2 mm tapes. These tapes were not according to the invention and were not interconnected by fibrils.

The breaking strength and the breaking tenacity were tested in accordance with ASTM D7269.

Table 2 shows the breaking strength and the breaking tenacity of the tested cords.

TABLE 2

| | Cords of split tapes (2 mm) | Cords of split tapes (2.5 mm) | Cords of unsplit tapes (Greige) |
|---|---|---|---|
| Linear density | 9850 dtex | 9820 dtex | 9056 dtex |
| Breaking strength | 1610 N | 1640 N | 1350 N |
| Breaking tenacity | 1640 mN/tex | 1680 mN/tex | 1500 mN/tex |

EXAMPLE 4

Cords were made of 20 mm tapes of UHMWPE (Endumax® TA23) with twist factor 60. In a first group the 20 mm tapes had been split in accordance with the invention, using a 2 mm pitch. In a second group the 20 mm tapes had been split in accordance with the invention, using a 2.5 mm pitch. In a third group the cords were made of 10 unsplit 2 mm tapes. These narrow tapes were not according to the invention and were not interconnected by fibrils.

The breaking strength and the breaking tenacity were tested in accordance with ASTM D7269.

Table 3 shows the breaking strength and the breaking tenacity of the tested cords.

TABLE 3

| | Cords of split tapes (2 mm) | Cords of split tapes (2.5 mm) | Cords of unsplit tapes (Greige) |
|---|---|---|---|
| Linear density | 9940 dtex | 9920 dtex | 9154 dtex |
| Breaking strength | 1410 N | 1330 N | 1070 N |
| Breaking tenacity | 1420 mN/tex | 1340 mN/tex | 1170 mN/tex |

The invention claimed is:

1. A process of splitting a tape of a uniaxially oriented material into a plurality of strips interconnected by fibrils, the process comprising:

passing the tape in a process direction over a splitting profile of a splitter, the splitting profile having a row of parallel cutting edges, each edge circumferentially extending about an entire outer diameter of the splitting profile in the process direction, wherein the cutting edges split the tape into the plurality of strips without cutting the interconnecting fibrils.

2. The process of claim 1, wherein the splitting profile is a static axle with triangular teeth showing a zigzag pattern when viewed in the process direction.

3. The process of claim 1, wherein the cutting edges are coaxially arranged.

4. The process of claim 1, wherein the tape is passed over the splitting profile with a processing speed of at least 1 m/min.

5. The process of claim 1, wherein the uniaxially oriented material is polyethylene.

6. A process for producing a rope, the process comprising:

the process of splitting the tape according to claim 1; and twisting the plurality of strips to form the rope after the tape is split.

* * * * *